US007290526B2

(12) United States Patent
Maruo et al.

(10) Patent No.: US 7,290,526 B2
(45) Date of Patent: Nov. 6, 2007

(54) THROTTLE BODY HAVING FUEL RETURN PASSAGE AND VEHICLE

(75) Inventors: Keisuke Maruo, Shizoka (JP); Mitsuharu Yamamoto, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 65 days.

(21) Appl. No.: 11/278,695

(22) Filed: Apr. 5, 2006

(65) Prior Publication Data

US 2006/0236980 A1 Oct. 26, 2006

(30) Foreign Application Priority Data

Apr. 7, 2005 (JP) ..... 2005-111208

(51) Int. Cl.
*F02D 9/10* (2006.01)

(52) U.S. Cl. ..... 123/339.14; 123/361

(58) Field of Classification Search ..... 123/339.14, 123/339.15, 361, 399, 400
See application file for complete search history.

(56) References Cited

U.S. PATENT DOCUMENTS 5,301,646 A * 4/1994 Doi et al. ..... 123/399
5,490,457 A * 2/1996 Boulanger et al. ..... 123/399
5,718,202 A * 2/1998 Bentz et al. ..... 123/399
6,247,447 B1 * 6/2001 Muraji ..... 123/399
6,347,613 B1 * 2/2002 Rauch ..... 123/337
6,725,833 B1 * 4/2004 Irihune et al. ..... 123/399
7,013,870 B2 * 3/2006 Kamimura et al. ..... 123/399

FOREIGN PATENT DOCUMENTS

JP 02-007368 1/1990
JP 2002-309968 10/2002

* cited by examiner

*Primary Examiner*—Thomas Moulis
(74) *Attorney, Agent, or Firm*—Keating & Bennett, LLP

(57) ABSTRACT

A throttle body includes a housing that accommodates a connector for a rotation shaft of a throttle valve disposed in the throttle body and a throttle position sensor, a fuel return passage that communicates the housing with an air intake passage in the throttle body, a T-shaped pipe that communicates with the air intake passage upstream from the throttle body to function as a pressure control chamber, and an air inflow passage that communicates the housing with the T-shaped pipe. The throttle body smoothly returns the fuel accumulated in a housing that accommodates a connector that connects a throttle position sensor to the end of the rotation shaft of a throttle valve to an air intake passage.

7 Claims, 8 Drawing Sheets

THROTTLE BODY HAVING FUEL RETURN PASSAGE AND VEHICLE

BACKGROUND OF THE INVENTION

1. Field of the Invention

The present invention relates to a throttle body having a fuel return passage.

2. Description of the Related Art

Conventional throttle bodies often have a throttle position sensor for detecting the opening of a throttle valve on the side of a bore of the throttle body. The throttle position sensor has a rotation shaft for operating a potentiometer. The throttle bodies have a connector for connecting the rotation shaft to one end of the rotation shaft on the side of the bore. Particularly, JP-A-2002-309968 discloses a structure having a housing for the connector to prevent adhesion of soil or water to the connector during driving of the vehicle, and a drain opening in the housing for discharging water accumulating in the housing to the outside.

However, for saddle type four wheel vehicles (e.g., four wheel buggies) that may drive on marshy or swampy ground, the drain opening may allow water to flow into the housing. Thus, a saddle type four wheel vehicle may have a closed drain opening which creates the possibility that fuel leaks gradually from the air intake passage of the throttle body to the housing and accumulates in the housing. In this case, the accumulated fuel may come into contact with the connector in the housing so that the throttle position sensor may not be able to detect a correct throttle opening.

In that respect, JP-A-2-7368 discloses a technique in which a fuel return passage is provided which connects the portion downstream from a control valve in a bypass passage that connects the upper stream and the lower stream of the throttle body and the portion upstream from a throttle valve in the throttle body, and the fuel accumulated in the bypass passage is returned to an air intake passage using a negative pressure in the air intake passage.

The technique described in JP-A-2-7368 may be applied to the above described throttle body including the throttle position sensor. Specifically, the throttle body may have a fuel return passage that communicates the housing with the portion of the air intake passage downstream from the throttle valve, and an air inflow passage that communicates the housing with the portion of the air intake passage upstream from the throttle valve.

However, the throttle body has a single piece structure, so that a relatively small pressure difference occurs in the air intake passage in the throttle body. This may increase the possibility that the fuel accumulated in the housing cannot be returned smoothly into the air intake passage even with the fuel return passage and air inflow passage. Especially, it is difficult that the fuel having a higher viscosity than water circulates under a small pressure difference.

SUMMARY OF THE INVENTION

In order to overcome the problems described above, preferred embodiments of the present invention provide a throttle body capable of smoothly returning the fuel accumulated in the housing that accommodates a connector for connecting a throttle position sensor to the end of the rotation shaft of a throttle valve to the air intake passage.

In order to solve the above-described problems, a throttle body according to a preferred embodiment of the present invention includes a throttle valve disposed in an air intake passage arranged in the throttle body and mounted to a rotation shaft journaled by the wall of the air intake passage, a throttle position sensor connected to one end of the rotation shaft for detecting the rotation angle of the rotation shaft, a housing that accommodates a connector for the end of the rotation shaft and the throttle position sensor, a fuel return passage that communicates the air intake passage with the housing, a pressure control chamber that communicates with the air intake passage upstream from the throttle body, and an air inflow passage that communicates the housing with the pressure control chamber. Here, the pressure control chamber communicates with the air intake passage upstream from the throttle body, in which the pressure is maintained higher than that of the air intake passage. According to the present preferred embodiment, the air inflow passage communicating with the housing communicates with the pressure control chamber. On the other hand, the fuel return passage communicating with the housing communicates with the air intake passage arranged in the throttle body. The difference in pressure between the pressure control chamber communicating with the air intake passage upstream from the throttle body and the air intake passage in the throttle body is large. Accordingly, the fuel accumulated in the housing circulates through the fuel return passage from the housing to the air intake passage under pressure, thereby preventing the fuel from accumulating in the housing. The pressure control chamber is not open to the atmosphere but communicates with the air intake passage. This structure prevents water, etc. from flowing through the air inflow passage communicating with the pressure control chamber into the housing during the driving of the vehicle.

According to another preferred embodiment of the present invention, the throttle body includes a bypass passage that communicates the portion downstream from the throttle valve and the portion upstream from the throttle valve, and the bypass passage connects to the pressure control chamber. In this case, the pressure control chamber can be used also as a pipe for communicating the upstream portion of the bypass passage with the air intake passage. Accordingly, the number of parts of the throttle body can be reduced. For the case where the existing throttle body includes a bypass passage, the pipe used for the bypass passage can be used as a pressure control chamber. This eliminates the need for processing the throttle body, thus increasing productivity.

According to another preferred embodiment of the present invention, the pressure control chamber has an inside diameter larger than the inside diameter of the bypass passage. In this case, the pressure control chamber connected to the air intake passage has an inside diameter larger than the inside diameter of the bypass passage. Accordingly, the flow rate of the air in the pressure control chamber is low, so that the pressure in the pressure control chamber is higher than that in the air intake passage. Thus, the pressure in the air inflow passage connected to the pressure control chamber is also maintained higher than that in the air intake passage. This structure increases the difference in pressure between the air inflow passage and the fuel return passage communicating with the air intake passage, allowing the fuel in the housing to be returned smoothly to the air intake passage.

According to another preferred embodiment of the present invention, the air intake passage includes an air cleaner and the pressure control chamber communicates with the portion of the air intake passage upstream from the throttle body and downstream from the air cleaner. In this case, air in which soil, etc. are removed by the air cleaner circulates through the air inflow passage, and then circulates through the fuel return passage together with the fuel accumulated in the housing into the air intake passage. Thus, the engine can always be supplied with clean air.

According to another preferred embodiment of the present invention, the air intake passage preferably includes an air cleaner, the air inflow passage communicates with the region downstream from the filter in the air cleaner, and the air cleaner functions as a pressure control chamber. In this case, air in which soil, etc. are removed by the air cleaner circulates through the air inflow passage, and then circulates through the fuel return passage together with the fuel accumulated in the housing into the air intake passage. Thus, the engine can always be supplied with clean air. The cross-sectional area for air circulation of the air cleaner is larger than that of the air intake passage downstream therefrom (e.g., the air duct). Thus, the pressure in the air cleaner becomes higher than that of the air intake passage downstream therefrom. Accordingly, with a structure in which the region of the air cleaner downstream from the filter is used as a pressure control chamber, the difference in pressure between the air inflow passage and the fuel return passage can be increased, so that the fuel in the housing can be returned smoothly to the air intake passage.

A saddle type vehicle or a compact four wheel vehicle according to another preferred embodiment of the present invention includes one of the above described throttle bodies. With the saddle type vehicle or compact four wheel vehicle including one of the throttle bodies, water can be prevented from flowing into the housing even when driven on marshy ground or the like, and fuel flowing gradually from the air intake passage into the housing can be returned to the air intake passage. Thus, saddle type vehicles or compact four wheel vehicles with great durability can be provided. The saddle type vehicles include motor bicycles (including motorbikes and motor scooters), four wheel buggies (all terrain vehicles), and snowmobiles. The compact four wheel vehicles include two seater or four seater four wheel buggies (all terrain vehicles).

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
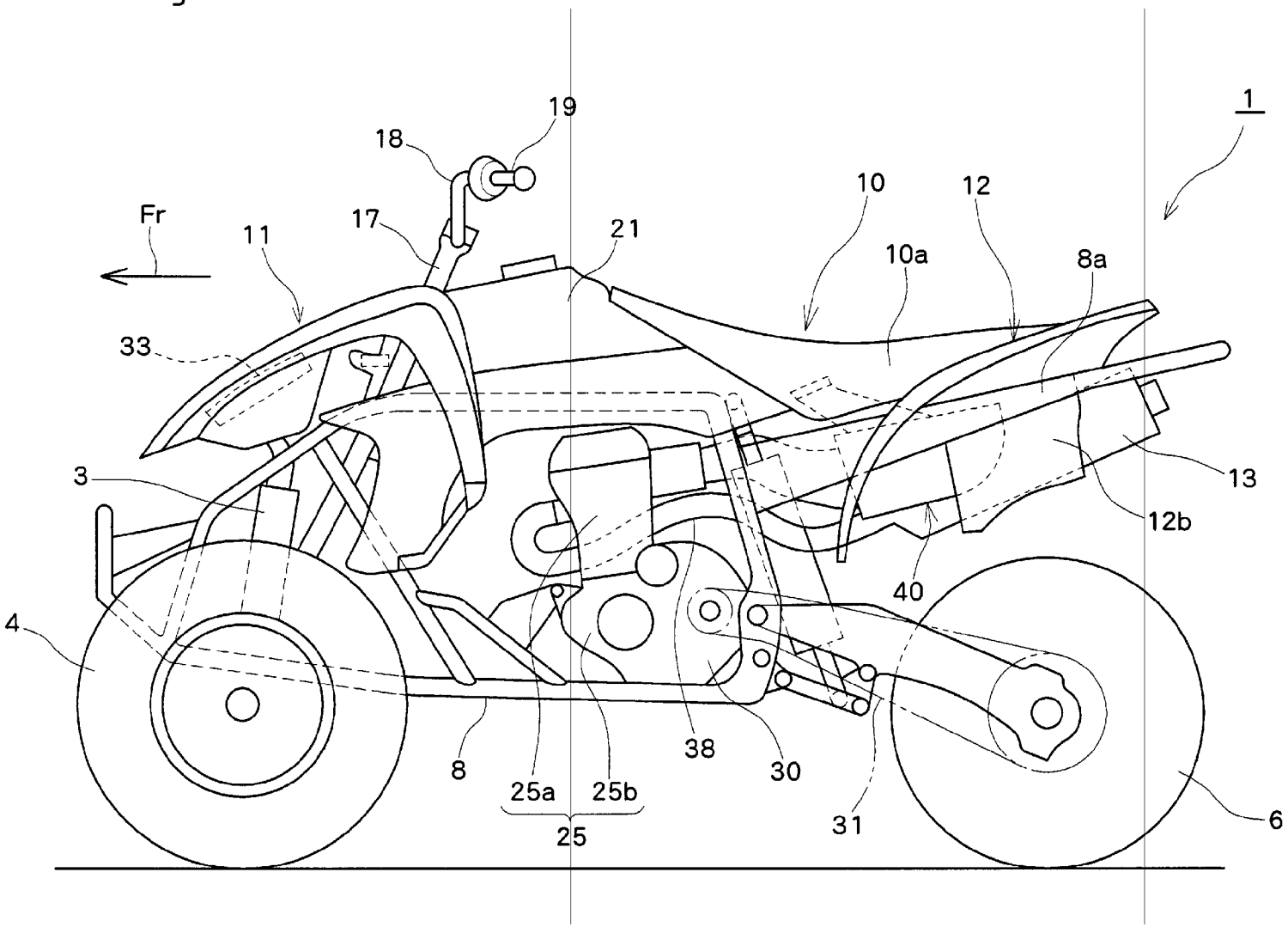
FIG. 1 is a side view of a saddle type vehicle according to a preferred embodiment of the present invention.
Figure 2:
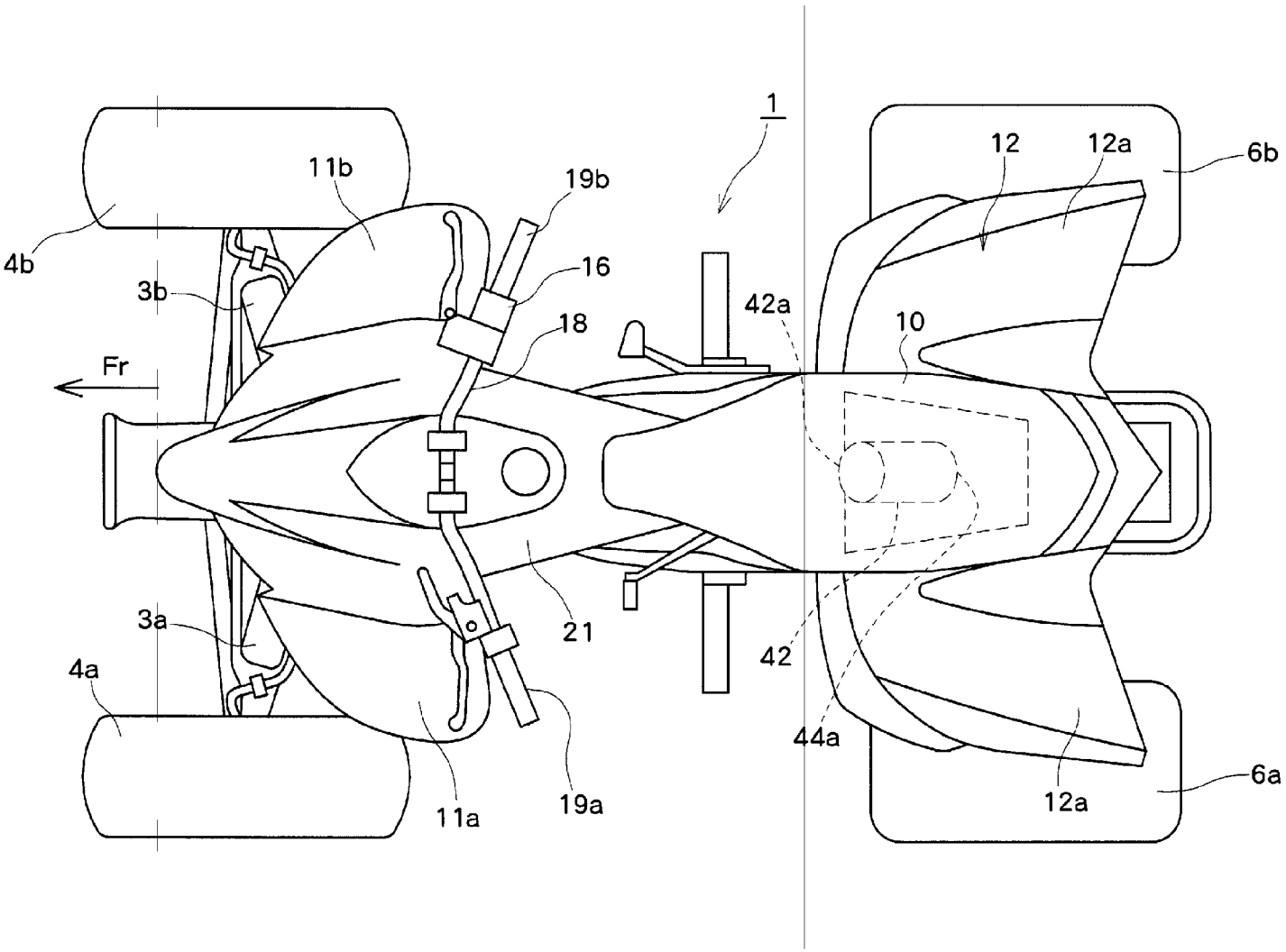
FIG. 2 is a plan view of the saddle type vehicle.
Figure 3:
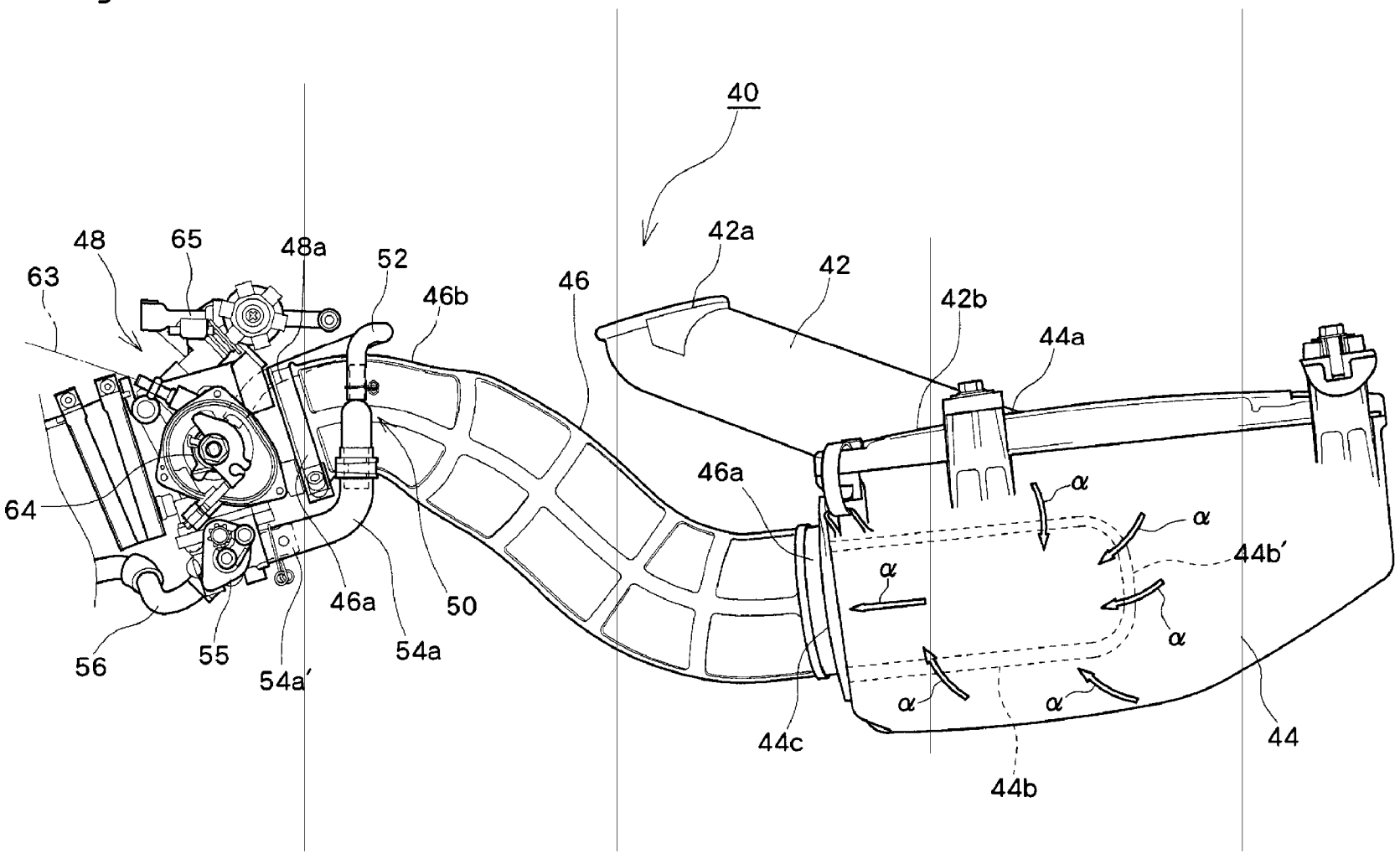
FIG. 3 is a side view of an air intake system according to a preferred embodiment of the present invention.
Figure 4:
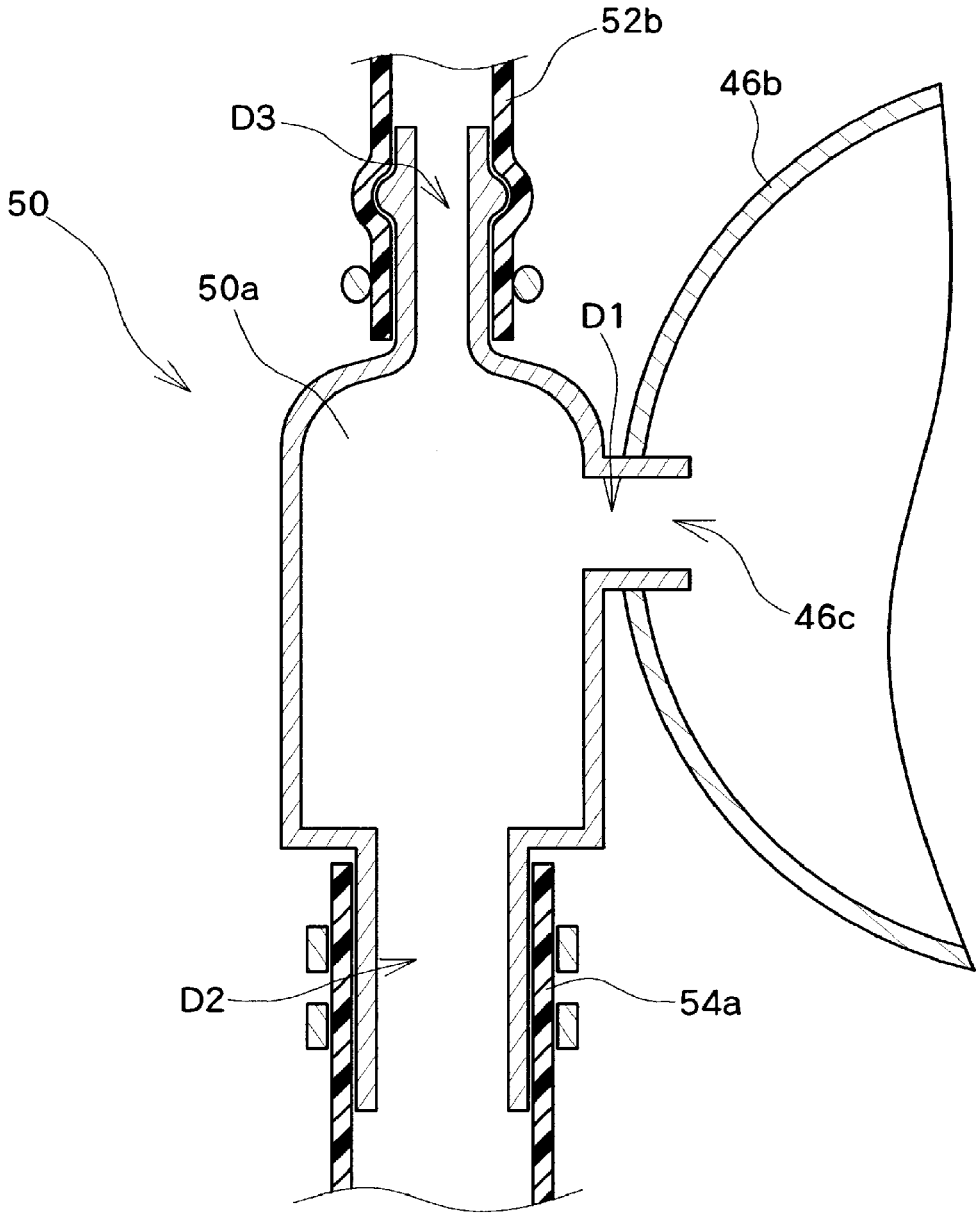
FIG. 4 is a cross-sectional view of a T-shaped pipe according to the preferred embodiment of FIG. 3.
Figure 5:
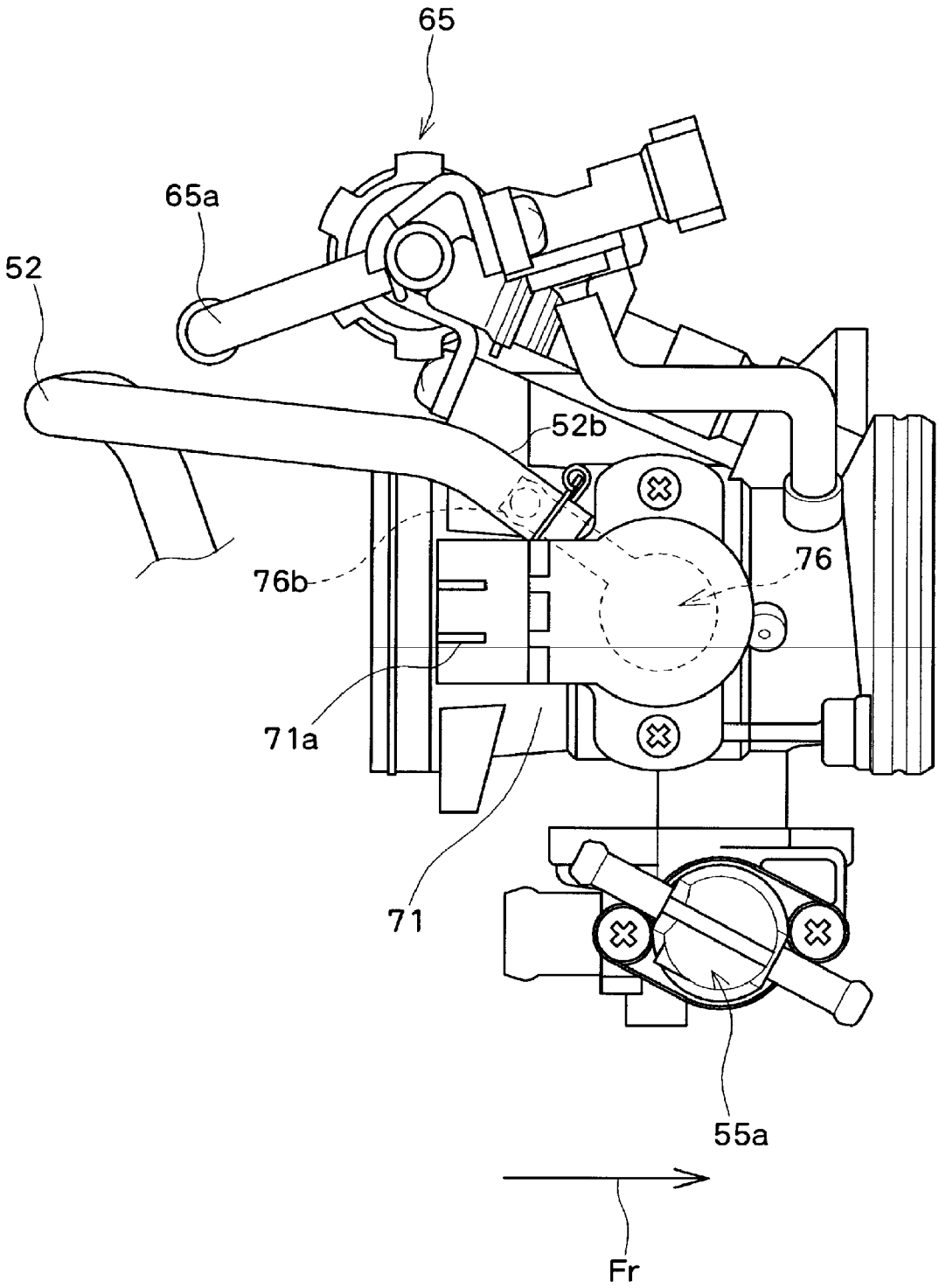
FIG. 5 is a side view of the throttle body according to the preferred embodiment of FIG. 3.
Figure 6:
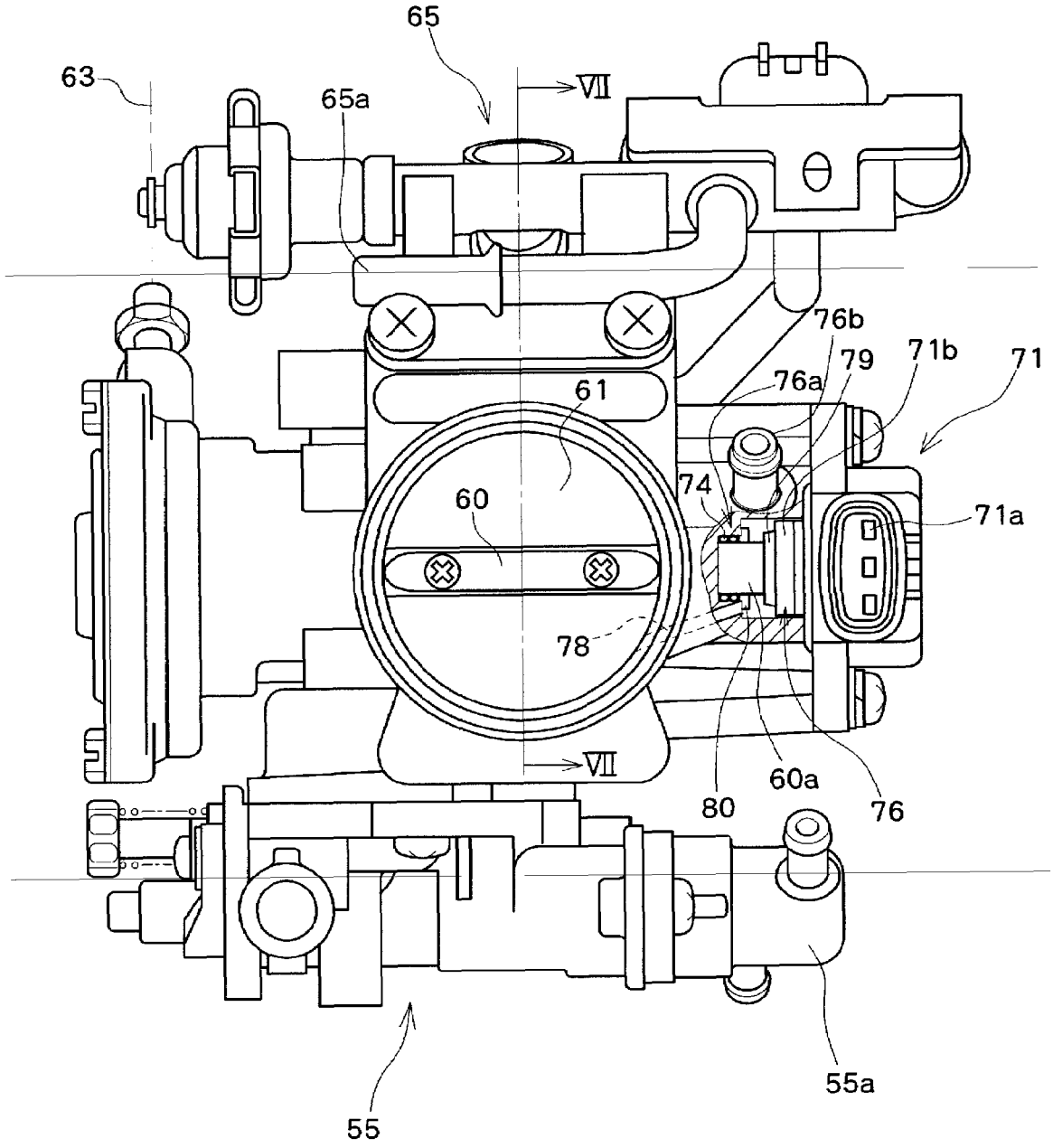
FIG. 6 is a back view of the throttle body according to the preferred embodiment of FIG. 3.
Figure 7:
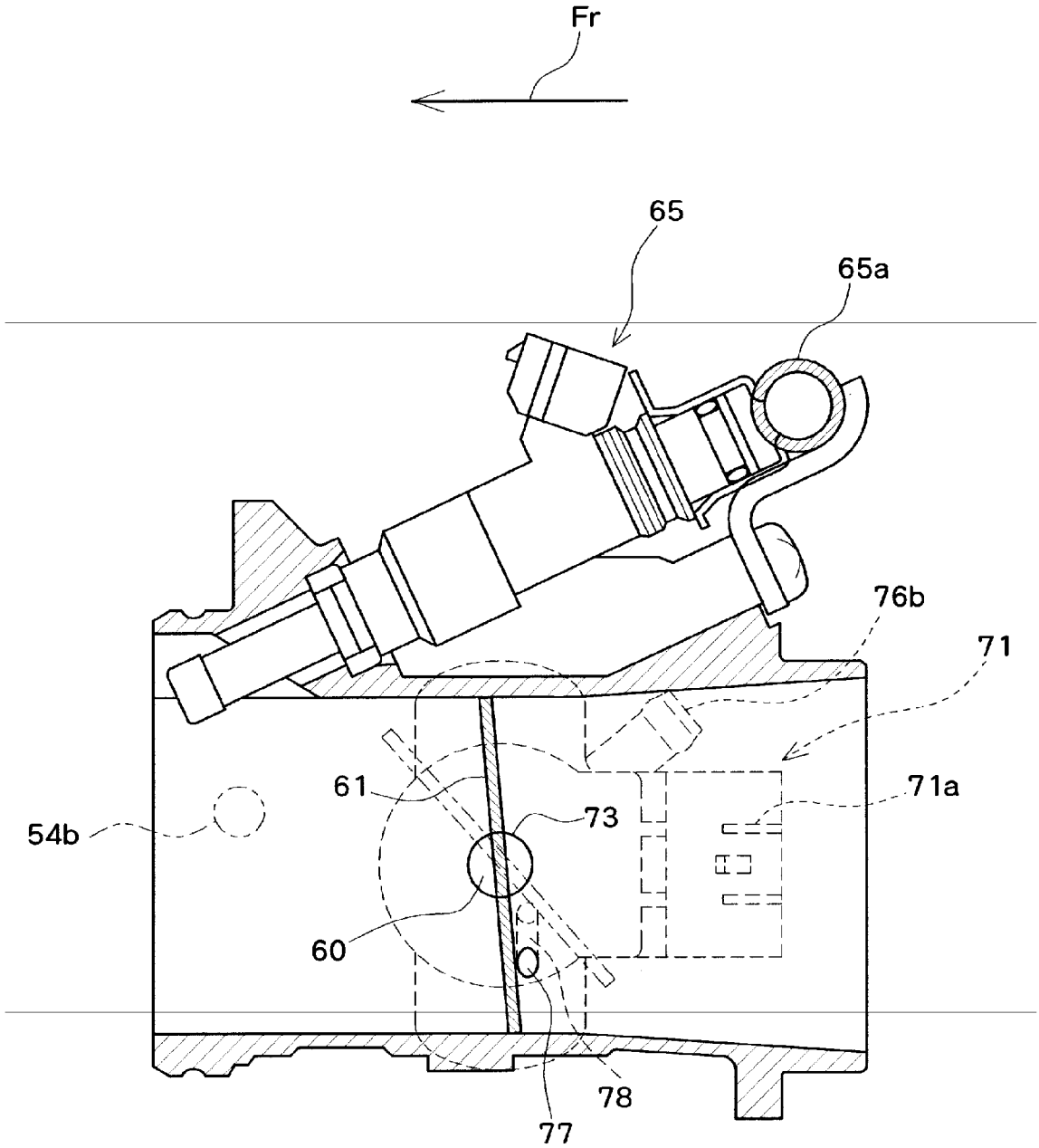
FIG. 7 is a cross-sectional view taken along line VII-VII of FIG. 6.

A throttle body and a saddle type vehicle according to preferred embodiments of the present invention will be described with reference to FIGS. 1 to 7. FIG. 1 is a side view of a saddle type vehicle according to a preferred embodiment of the present invention. FIG. 2 is a plan view of the saddle type vehicle according to the present preferred embodiment. The saddle type vehicle in FIGS. 1 and 2 is preferably an all terrain vehicle. FIG. 3 is a side of an air intake system including a throttle body according to a preferred embodiment of the present invention. FIG. 4 is a cross-sectional view of a pressure control chamber, FIG. 5 is a right side view of the throttle body in the traveling direction, FIG. 6 is a partial cross-sectional view of the throttle body viewed from the rear in the traveling direction, and FIG. 7 is a cross-sectional view taken along line VII-VII of FIG. 6.

As shown in FIGS. 1 and 2, a vehicle 1 has front suspensions 3 (3*a* and 3*b*) on the left and right of the vehicle at the front in the direction of travel (indicated by arrow Fr in the drawings), and front wheels 4 (4*a* and 4*b*) journaled at the lower ends. Front fenders 11 (11*a* and 11*b*) are disposed on the left and right above the front wheels 4*a* and 4*b*. The upper ends of the front suspensions 3*a* and 3*b* are supported by a body frame 8. The front end of the body frame 8 in the traveling direction journals a steering shaft 17 such that the front end can be turned to the right and left. At the upper end of the steering shaft 17, a handle 18 extending to the right and to the left is supported at the center thereof. Grips 19 (19*a* and 19*b*) are provided on both ends of the handle 18. The right grip 19*b* has an accelerator 16. The accelerator 16 is operated by the pressure of a driver's fingers during driving. A radiator 33 is provided ahead of the steering shaft 17. The radiator 33 circulates cooling water in the radiator 33 to cool the cooling water with air passing from the front, thereby releasing heat generated from an engine 25. An exhaust pipe 38 connects to the front of the engine 25. The exhaust pipe 38 extends forward from the engine 25 and then bends in a U-shape toward the rear in the traveling direction. The rear end of the exhaust pipe 38 connects to a muffler 13. Exhaust gas discharged from the engine 25 circulates through the exhaust pipe 38 and is then discharged from the rear of the muffler 13. The engine 25 is constructed of an internal combustion engine 25*a* and a crank 25*b* disposed under the internal combustion engine. Driving force output from the engine 25 is transmitted through a transmission 30 and a chain mechanism 31 to rear wheels 6 (6*a* and 6*b*). Rear fenders 12 (12*a* and 12*b*) are disposed on the left and right above the rear wheels 6*a* and 6*b*. The engine 25 is suspended by the body frame 8 at the upper portion thereof, and supported by the body frame 8 at the lower portion thereof.

The body frame 8 includes right and left frames that are joined together at the front ends. Both frames preferably have the shape of an approximate rectangle whose lower side is longer. The frames have right and left seat frames 8*a* on the upper portions of the right and left approximately rectangular frames. The seat frames 8*a* are located at the rear of the frames in the traveling direction and extending to the rear in the traveling direction. The upper portions of the seat frames 8*a* support a seat 10. The seat frames 8*a* each bend inward along the width of the vehicle at the rear, and connect to each other at the rearmost in the center of the width of the vehicle. In front of the seat 10 is disposed a fuel tank 21. The fuel tank 21 is supported by the body frame 8.

There is an intake system 40 under the seat 10 for supplying air to the engine 25. Specifically, the intake system 40 includes an air intake cylinder 42, an air cleaner 44, an air duct 46, and a throttle body 48. As shown in FIG. 3, the air intake cylinder 42 has an air intake port 42*a* whose top is open to the above. The air intake cylinder 42 is disposed so that the side 10*a* of the seat 10 is located to the side of the air intake port 42*a*. Thus, the air intake port 42*a* is covered by the seat 10, preventing water or soil from flowing through the air intake port 42*a* into the intake system 40. As shown in FIG. 3, the air intake cylinder 42 extends from the air intake port 42*a* to the rear, and connects to the inlet 44*a* of the air cleaner 44 at the rim of the end 42*b* of the air intake cylinder 42.

A cylindrical filter 44*b* having a bottom 44*b*' is disposed at the front of the air cleaner 44 in the traveling direction. Air supplied from the air intake cylinder 42 circulates through the filter 44*b*, and is discharged from a supply port 44*c* disposed at the front of the air cleaner 44 in the traveling direction. In FIG. 3, reference symbol α indicates the direction of air flow.

The supply port 44*c* of the air cleaner 44 connects to an inlet 46*a* of the air duct 46. The air discharged from the supply port 44*c* of the air cleaner 44 flows through the inlet 46*a* into the air duct 46. The air duct 46 bends obliquely upward from the rear in the traveling direction, and then extends substantially horizontally. The inlet 46*a* of the air duct 46 disposed at the frontmost in the traveling direction connects to an inlet 48*a* of the throttle body. The air duct 46 has a small diameter portion 46*b* upstream from the inlet 46*a* to increase the flow rate of the air supplied from the air cleaner 44.

To the side of the small diameter portion 46*b* of the air duct 46, a T-shaped pipe 50 is connected. As shown in FIG. 4, the T-shaped pipe 50 has a bore 50*a* and three pipes D1, D2, and D3 connected to the bore 50*a*. The pipes D2 and D3 are disposed so that the center lines are on an identical straight line, the pipe D1 is disposed so that the center line crosses the center lines of the pipes D2 and D3 at a right angle. The pipe D1 passes through a through hole 46*c* provided in the side wall of the small diameter portion 46*b* and into the small diameter portion 46*b* at a right angle. The side of the pipe D1 and the rim of the through hole 46*c* are joined together. The pipe D3 connects to an extendable air inflow passage 52, to be described later, from the exterior. The pipe D2 connects to an upstream bypass passage 54*a* for supplying idle air to the throttle body 48 from the exterior. The inside diameter of the pipe D3 is smaller than the inside diameters of the pipes D1 and D2.

The bore 50*a* is a substantially cylindrical space whose center line extends in the same direction as the center lines of the pipes D3 and D2. The inside diameter of the bore 50*a* is larger than the inside diameters of the pipes D1 to D3. The bore 50*a* works as a pressure control chamber when the idle air becomes unnecessary for the throttle body 48, so that no air circulates through the upstream bypass passage 54*a*.

In other words, the pressure control chamber is a region that communicates with the air intake passage upstream from the throttle body 48 and maintains a higher pressure than the air intake passage, because the air flow rate is lower than the air flow rate in the air intake passage. In this preferred embodiment, the pipe D1 passes through the small diameter portion 46*b* of the air duct 46 at a right angle, so that the direction of air flow in the pipe D1 is perpendicular to the direction of air flow in the small diameter portion 46*b* of the air duct 46. Accordingly, when the supply of idle air to the throttle body 48 becomes unnecessary, and air flow to the pipe D2 is stopped, the air flow rate in the bore 50*a* becomes lower than the air flow in the small diameter portion 46*b* of the air duct 46. As a result, the pressure in the bore 50*a* becomes higher than the pressure in the small diameter portion 46*b* of the air duct 46 and as such, the bore 50*a* functions as a pressure control chamber. The pressure in the air inflow passage 52 connected to the bore 50*a* is also maintained higher than the pressure in the small diameter portion 46*b* of the air duct 46. The air inflow passage 52 communicates with the air intake passage of the throttle body 48 through a fuel return passage 78, to be described later. The air in the bore 50*a* therefore flows into the air intake passage of the throttle body 48 through the air inflow passage 52 and the fuel return passage 78. The air inflow passage 52 and the air intake passage of the throttle body 48 will be described later in detail.

Referring back to FIG. 3, the intake system 40 will be described. An idle valve 55 is mounted under the throttle body 48. The inlet of the idle valve 55 connects to the end 54*a*' of the upstream bypass passage 54*a*. The outlet of the idle valve 55 communicates with a downstream bypass passage 54*b* disposed in the throttle body 48. The bypass passage 54*b* communicates with an opening in the wall of the air intake passage of the throttle body (refer to FIG. 7). When the temperature of the cooling water detected by a temperature sensor 55*a* (refer to FIG. 5) of the idle valve 55 is low, the idle valve 55 is opened so that idle air circulates through the upstream bypass passage 54*a* and the downstream bypass passage 54*b* and into the engine 25. On the other hand, when the temperature of the cooling water is high, the idle valve 55 is closed so that the supply of idle air from the bypass passages is stopped. The cooling air used in the temperature sensor 55*a* circulates through a hose 56 toward the cooling water passage in the engine 25. During the driving of the vehicle, the cooling water is increased in temperature by the heat from the engine, and flows into the temperature sensor 55*a*. Thus, the idle valve 55 controls the supply of idle air to the engine 25.

The inlet 48*a* of the throttle body 48 connects to the inlet 46*a* of the air duct 46. A throttle valve 61 is disposed in the bore of the throttle body 48. The degree of opening of the throttle valve 61 can be varied through the operation of the accelerator 16 by the driver. Specifically, as shown in FIGS. 3, 6, and 7, the throttle body 48 including the air intake passage has a throttle valve 61 mounted to a rotation shaft 60 that is journaled by the wall of the air intake passage. The throttle valve 61 is fixed to the rotation shaft 60 preferably with screws or other fastening members. One end of the rotation shaft 60 mounts a lever (not shown) that rotates with an accelerating operation. The lever connects to a wire 63. When the accelerator 16 is depressed, the lever rotates in the direction in which the throttle valve 61 opens against the biasing force of a spring 64, and when the depression of the accelerator 16 is released, the lever rotates in the direction in which the throttle valve 61 closes by the biasing force of the spring 64.

An injector 65 is mounted on the throttle body 48. The injector 65 emits a jet of fuel of an amount corresponding to the amount of air supplied to the engine 25 through the throttle valve 61 to the downstream air intake passage by an engine control unit ECU (not shown). The fuel circulates from the fuel tank 21 through a fuel supply pipe 65*a* to the injector 65.

As shown in FIGS. 5 to 7, the throttle body 48 mounts a throttle position sensor 71 on its side, which detects the rotation angle of the rotation shaft 60 of the throttle valve 61, and outputs a voltage corresponding to the rotation angle from a terminal 71*a* to the ECU. Specifically, a linear through hole 73 with a circular cross section is provided in the wall of the air intake passage of the throttle body 48 such that it extends to the outside of the air intake passage. The through hole 73 has the rotation shaft 60 mounted there-through and the rotation shaft 60 has a diameter that is substantially the same as the inside diameter of the through hole 73. The end 60*a* of the rotation shaft 60 projects from the through hole 73 to the outside of the air intake passage into a ring-shaped connector 79. The throttle position sensor 71 includes a potentiometer (not shown). A rotator 71*b* of the potentiometer has vertical and lateral grooves intersecting each other. The connector 79 has a lateral projection at the end adjacent to the throttle position sensor 71. The projection is fitted in the lateral groove of the rotator 71*b* of the potentiometer. Thus, the rotator 71*b* of the throttle position sensor 71 rotates in synchronization with the rotation shaft 60 via the connector 79.

A housing 76 that accommodates the connector 79 together with the end 60*a* of the rotation shaft 60 and the rotator 71*b* of the throttle position sensor 71 is provided around the connector 79. The structure in which the joint portion between the rotator 71*b* and the end 60*a* is accommodated in the housing 76 prevents the throttle position sensor 71 from reading incorrect values due to adhesion of water or soil to the joint portion during traveling. A ring-shaped sealing member 74 whose inside diameter is the same as the diameter of the rotation shaft 60 is fitted on the portion of the rotation shaft 60 accommodated in the housing 76. The housing 76 has a substantially cylindrical space therein, and in the housing the portion adjacent to the air intake passage has a recess 76*a* having an inside diameter smaller than that of the other portion. The recess 76*a* houses the sealing member 74 in which the rotation shaft 60 is fitted. A ring 80 having threads is fitted on the rotation shaft 60 from the outside of the sealing member 74. The recess 76*a* is also threaded around the inner periphery of the rim thereof. The recess 76*a* and the ring 80 are screwed to each other so that the ring 80 biases the sealing member 74 to the air intake passage, thereby preventing leakage of fuel circulating in the air intake passage to the housing 76.

However, when the vehicle is used for a long period, the fuel may gradually pass through the sealing member 74 and the ring 80 into the housing 76 and as such, the throttle position sensor 71 may not read correct values. Accordingly, in this preferred embodiment, an opening 77 is provided a little upstream from a closed position of the throttle valve 61 (a position at which the throttle valve closes) in the wall of the air intake passage adjacent to the throttle position sensor 71 to form a linear fuel return passage 78 that communicates the opening 77 with the housing 76. Also, an air port 76*b* for introducing air into the housing 76 is provided in the housing 76, and the air port 76*b* and the other end 52*b* of the air inflow passage 52 are connected (refer to FIG. 5) so that the housing 76 communicates with the bore 50*a* through the air inflow passage 52. Accordingly, when the throttle valve 61 is opened, so that the opening 77 becomes downstream from the throttle valve 61 in the air intake passage, a large pressure difference occurs between the bore 50*a* and the air intake passage having the opening 77 so as to return the fuel in the housing 76 to the air intake passage. More specifically, when the supply of idle air is stopped, the pressure P2 in the air duct 46 is lower than the pressure P1 in the bore 50*a* working as a pressure control chamber, as described above. When the throttle valve is open, the pressure P3 in the portion downstream from the throttle valve 61 is lower than the pressure P2 in the air duct 46. As a result, the pressures in the air passages have the relationship, P1>P2>P3. Accordingly, the air circulates through the air inflow passage 52 into the housing 76, and then circulates through the fuel return passage 78 together with the fuel accumulated in the housing 76 into the air intake passage. The inside diameter of the fuel return passage 78 is smaller than that of the air port 76*b*. Thus, the flow rate of the air in the fuel return passage 78 increases to allow the fuel to be returned to the air intake passage more smoothly together with the air. The high air flow rate of the fuel return passage 78 allows the fuel in the housing 76 to be returned to the air intake passage of the throttle body 48 smoothly even when the pressure in the pressure control chamber communicating with the air inflow passage 52 becomes low.

Figure 8:
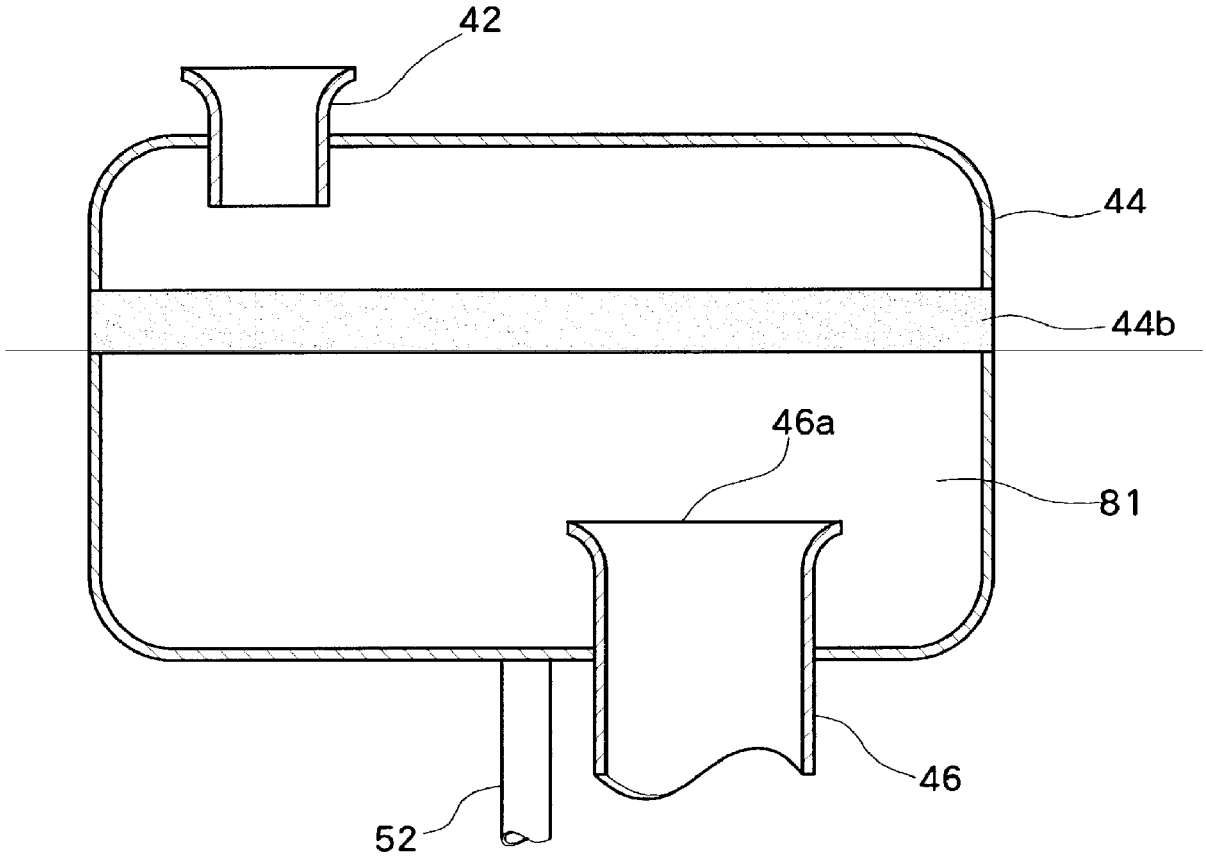
FIG. 8 is a cross-sectional view of a pressure control chamber according to another preferred embodiment of the present invention.

The present invention is not limited to the foregoing preferred embodiments, so various modifications may be made. For example, the air inflow passage 52 may be connected to the region downstream from the filter 44*b* in the air cleaner 44 so that the downstream region functions as a pressure control chamber. FIG. 8 is a cross-sectional view of the air cleaner 44 of this preferred embodiment. As shown in the drawing, the filter 44*b* is disposed in the air cleaner 44, the air intake cylinder 42 connects upstream from the filter 44*b*, and the air duct 46 connects downstream from the filter 44*b*. The air inflow passage 52 connects to a region 81 (hereinafter, referred to as a downstream region) downstream from the filter 44*b* in the air cleaner 44. The air cleaner 44 is constructed so that the air circulating cross-section area of the air cleaner 44 is larger than the cross-section area of the air duct 46 and the air intake cylinder 42. The air flow rate in the air cleaner 44 is therefore lower than the air flow rate in the air duct 46. The pressure in the downstream region 81 of the air cleaner 44 is higher than the pressure in the air intake passage in the throttle body 48, which is disposed downstream from the air duct 46, so that the air in the downstream region 81 passes through the air inflow passage 52 into the housing 76, and is then released to the air intake passage together with the fuel accumulated in the housing 76. Since the joint position of the air inflow passage 52 to the air cleaner 44 is located at a position separate from the inlet 46*a* of the air duct 46, the air flow rate in the vicinity of the position at which the air inflow passage 52 is connected to the air cleaner 44 is decreased even more. This further increases the difference in pressure between the air intake passage of the throttle body 48 and the vicinity of the joint position for the air inflow passage 52, allowing the fuel accumulated in the housing 76 to be returned to the air intake passage smoothly.

In the foregoing preferred embodiments, the upstream bypass passage 54*a* and the air inflow passage 52 are connected to the bore 50*a*. Alternatively, the upstream bypass passage 54*a* may not be connected to the bore 50*a*, but may be connected to a position on the side of the air duct 46 different from the bore 50*a*. In this case, of course, the pipe D2 of the bore 50*a* becomes unnecessary, so that the bore 50*a* communicates the air intake passage in the air duct 46 with the air inflow passage 52 to function only as a pressure control chamber for maintaining the pressure in the air inflow passage 52 higher than the pressure of the air intake passage.

While, in the present preferred embodiments, the pipe D1 connected to the bore 50*a* passes vertically through the air duct 46, the direction in which the pipe D1 is disposed is not limited to that. For example, with a structure in which the pipe D1 is offset from the direction of air circulation in the air duct 46, the flow rate of the air in the bore 50*a* can be decreased when the inside diameter of the bore 50*a* is made larger than that of the pipe D1 to increase the volume of the bore 50*a*, so that the bore 50*a* can be used as a pressure control chamber.

Although, in the above preferred embodiments, the bore 50*a* is a substantially cylindrical space, whose diameter is larger than the inside diameters of the pipes D1 to D3, it is not limited to that. With the structure in which the pipe D1 connects to the air duct 46 so as to be perpendicular to the direction of air circulation of the air duct 46, the flow rate of the air in the bore 50*a* is decreased. Accordingly, even when the diameter of the bore 50*a* is smaller than the inside diameter of any of the pipes or the volume of the bore 50*a* is smaller than the volume of any of the pipes, the bore 50*a* can be used as a pressure control chamber.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A throttle body comprising:

a throttle valve disposed in an air intake passage of the throttle body, the throttle valve being mounted to a rotation shaft journaled by a wall of the air intake passage;

a throttle position sensor connected via a connector to one end of the rotation shaft and arranged to detect a rotation angle of the rotation shaft;

a housing that accommodates the connector;

a fuel return passage arranged to communicate the air intake passage with the housing;

a pressure control chamber arranged to communicate with the air intake passage upstream from the throttle body; and an air inflow passage arranged to communicate the housing with the pressure control chamber.

2. The throttle body according to claim 1, further comprising a bypass passage that communicates a portion downstream from the throttle valve and a portion upstream from the throttle valve, wherein the bypass passage is connected to the pressure control chamber.

3. The throttle body according to claim 2, wherein the pressure control chamber has an inside diameter that is larger than an inside diameter of the bypass passage.

4. The throttle body according to claim 1, wherein the air intake passage includes an air cleaner, and the pressure control chamber communicates with the portion of the air intake passage upstream from the throttle body and downstream from the air cleaner.

5. The throttle body according to claim 1, wherein the air intake passage includes an air cleaner having a filter, the air inflow passage communicates with a region downstream from the filter in the air cleaner, and the air cleaner functions as a pressure control chamber.

6. A saddle type vehicle comprising the throttle body according to claim 1.

7. A four wheel vehicle comprising the throttle body according to claim 1.

* * * * *